US007976448B2

(12) United States Patent
Jannin et al.

(10) Patent No.: US 7,976,448 B2
(45) Date of Patent: Jul. 12, 2011

(54) METHOD AND INSTALLATION FOR ASSEMBLING A COMPOSITE BOX

(75) Inventors: Michel Jannin, Octeville sur Mer (FR); Pascal Murano, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 66 days.

(21) Appl. No.: 12/446,383

(22) PCT Filed: Oct. 19, 2007

(86) PCT No.: PCT/FR2007/001726

§ 371 (c)(1),
(2), (4) Date: Apr. 20, 2009

(87) PCT Pub. No.: WO2008/047009

PCT Pub. Date: Apr. 24, 2008

(65) Prior Publication Data

US 2010/0069209 A1 Mar. 18, 2010

(30) Foreign Application Priority Data

Oct. 20, 2006 (FR) ..... 06 09199

(51) Int. Cl.
*B31B 1/62* (2006.01)

(52) U.S. Cl. ..... 493/128; 493/84; 493/102; 493/183; 156/69; 156/566; 53/287

(58) Field of Classification Search ..... 493/84, 493/114, 102, 123, 126, 128, 150, 151, 162, 493/183; 53/287; 156/69, 566
See application file for complete search history.

(56) References Cited

U.S. PATENT DOCUMENTS

| | | | | | |
|---|---|---|---|---|---|
| 3,634,995 | A | * | 1/1972 | Curtis | 53/485 |
| 3,913,300 | A | * | 10/1975 | Benzing | 53/287 |
| 4,117,646 | A | * | 10/1978 | James et al. | 53/488 |
| 4,674,261 | A | * | 6/1987 | Sabel | 53/242 |
| 4,798,571 | A | | 1/1989 | Everman et al. | |
| 6,048,421 | A | * | 4/2000 | White | 156/69 |

FOREIGN PATENT DOCUMENTS

| | | | |
|---|---|---|---|
| BE | 840 677 | A2 | 8/1976 |
| DE | 41 03 609 | A1 | 8/1992 |
| DE | 196 52 903 | A1 | 7/1998 |
| EP | 0 637 548 | A1 | 2/1995 |
| EP | 1 705 125 | A1 | 9/2006 |

* cited by examiner

*Primary Examiner* — Thanh K Truong
(74) *Attorney, Agent, or Firm* — Sughrue Mion, PLLC

(57) ABSTRACT

The invention relates to a method for assembling a composite box, in two parts, the method being implemented by a machine having: a conveyor system for bringing an envelope into position; a store for storing the blanks of the trays; means in the form of extractor arms for removing one of the tray blanks from the store and bringing it to the assembly station, facing the envelope; a device for gluing the edges of the envelope and the tongues of the tray blank during the movement towards the assembly station; a framework having two mobile carriages, a first carriage carrying a die for shaping the blank, and a second carriage carrying a tappet for driving the envelope towards the die and a stamp maintaining a counter-pressure using a suitable device against the pressing device of the die.

12 Claims, 5 Drawing Sheets

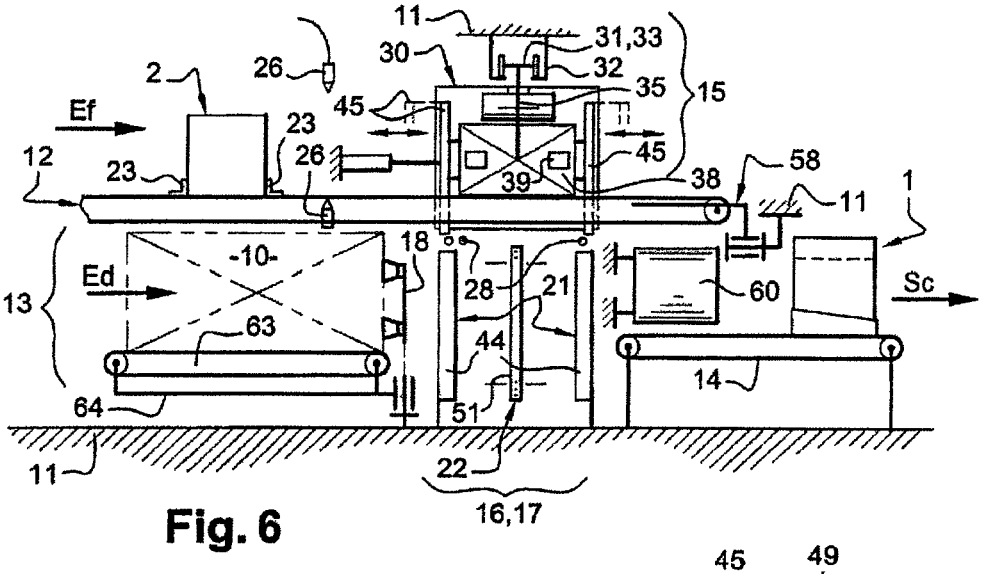
Fig. 6
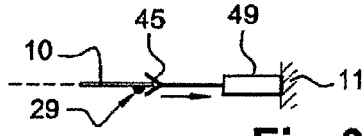
Fig. 9
Fig. 8
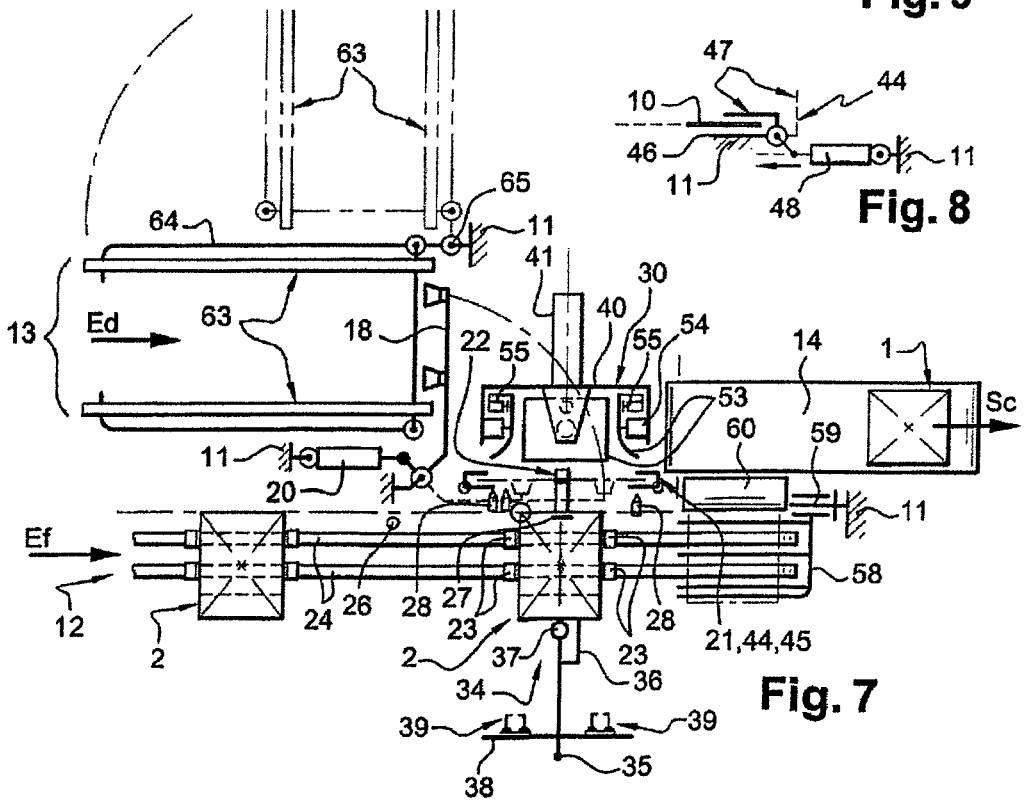
Fig. 7

METHOD AND INSTALLATION FOR ASSEMBLING A COMPOSITE BOX

FIELD OF THE INVENTION

This invention relates to a process for constructing a composite cardboard box.

It relates, more specifically, to a box that consists of two parts assembled by gluing;

a bottomless "½ American box"-type part with or without upper flaps, and a part in the form of a tray that acts as a base.

This invention also relates to the installation, i.e. the machine that enables the process for constructing this type of composite cardboard box to be implemented.

DESCRIPTION OF THE PRIOR ART

This type of composite box is used to wrap and package diverse and varied products found in large and medium distribution departments.

Indeed, this two-part box is suitable for serving as a display. It is brought to the department and, on site, the box part can be detached so as to leave only the tray, which holds the products and acts as a display.

The construction of these boxes is not a simple operation because it involves the forming of two cardboard cutouts, then the assembly thereof. However, the material, namely corrugated cardboard, is not known for its precision or for its manufacturing tolerances.

The construction of this type of box can be envisaged only by shaping one of the parts on the other, such as, for example, by assembling the tray cutout directly on the box with a suitable assembly.

SUMMARY OF THE INVENTION

The invention proposes a process for shaping this type of box, which is based on the well-known "wrap-around" technique, i.e. the cutout of the tray is formed directly on and by the box blank, in which said box blank has itself been preformed in a conventional manner from a cutout.

The invention enables a shaping machine to be proposed for implementing the process, which is in a compact, linear form.

This machine can also be in the form of a module associated with a machine for forming ½ American box-type cutouts. This assembly then constitutes a general machine for shaping composite boxes, which can easily be integrated in a line for wrapping and packaging products, or replace other existing solutions.

The process relates to the construction of a composite cardboard box, i.e. a box of the type including two parts:—a ½ American box and—a tray acting as a base, which tray comprises flanks and tongues for assembling said flanks together, which process consists, in a first stage, of erecting the ½ American box cutout in the form of a sheath of which the axis of symmetry is perpendicular to its direction of movement on the machine, and, in a second stage, of:

moving said sheath in order to position it in a repository located at the level of a station for assembling said two parts;

picking up, in a storage site that is arranged near said assembly station and with suitable means, a tray cutout;

applying glue to said sheath and said tray cutout as they are moving, in which said sheath receives bond lines on its longitudinal sides and said tray cutout receives bond lines on its tongues;

positioning and holding said tray cutout in another repository at the level of said assembly station, between said sheath and a matrix for forming said tray cutout;

installing a press in said sheath, at the level of its end, which is waiting for said tray;

bringing said tray cutout and said sheath together, in which said sheath serves as a support for said cutout while the matrix begins to fold the flanks of the latter;

applying and pressing said flanks of the tray cutout on the end of said sheath by means of the matrix;

applying and pressing said tongues on the corresponding flanks;

bringing the composite box to the repository of said sheath, and releasing it substantially upstream of its anterior position in said repository, for removal thereof.

Also according to the invention, the process consists of:

picking up the tray cutout in a storage site of which the bed is located at a level below that of the bed of the assembly station, in which the distance between the two beds is at least equal to the vertical dimension of said tray cutout increased by the maximum vertical dimension of a flank;

raising said tray cutout, between its storage site and said assembly station, in a vertical guide passage and according to a movement perpendicular to the forward movement of the sheath;

allowing said tray cutout to be taken over, at the level of the assembly station, by plate-type means equipped with suction cups, which means are capable of being moved along an axis parallel to the axis of the sheath under the effect of an actuator in order to be placed in the active position for handling said tray cutout, and these same means are then free, on their axis, during the assembly of the tray cutout and during its assembly with the sheath.

According to another arrangement of the invention, the process consists of:

moving the sheath transversally, in its repository, by means of a push member and clamps arranged on the supporting structure of the press;

folding the flanks of the tray cutouts by placing their tongues on the corresponding flanks;

pressing said tongues on said corresponding flanks, near the angles of said sheath, by means of actuators installed on the matrix;

pressing the longitudinal flanks of the tray thus formed on the longitudinal sides of the sheath by means of the matrix and the press in order to assemble said tray and said sheath, in which said press comprises actuator-type means for applying counter-pressure and optimizing the assembly;

deactivating the means for handling the tray cutout;

moving the supporting structure of the expansible template and the matrix in order to extract, by means of said clamps, the composite box from said matrix;

deactivating said clamps in order to release said box in its repository by means of a stop that receives said box at the level of its free peripheral edge, which release is performed upstream of its anterior position on the repository so as to avoid any interference between said repository and the flanks of the tray, which are attached to the sheath;

moving the composite box toward the outlet and pivoting it on a removal conveyor by placing its tray-type base on said conveyor.

The invention also relates to the machine that enables the process of constructing a composite box consisting of a sheath and a tray acting as a base to be implemented. This machine includes:

a conveyor system for transferring the sheath, which has been pre-assembled at the forming station, which sheath is transferred in and with its repository;

a storage site for storing the tray cutouts;

means forming extractor arms for picking up said tray cutouts one by one in said storage site and bringing them to a repository, at the level of the assembly station, opposite said sheath;

means for applying glue to the edges of the longitudinal sides of the sheath and the tongues of the tray cutout as they are moving toward said assembly station;

a portal frame that is arranged transversally above said conveyor system, in the median vertical plane of said assembly station, which portal frame comprises two mobile structures: a first structure that has a matrix for shaping the tray cutout and a second structure that has a push member suitable for cooperating with the free periphery of said sheath in order to drive it toward said matrix and cause said sheath to act as a support;

means arranged on the matrix in order to press said flanks of the tray cutout on the sheath and press-type means, which press is arranged on the supporting structure of said push member, upstream of the latter, and is capable of penetrating to the end of said sheath in order to maintain, with suitable actuator-type means, a counter-pressure opposite the matrix pressing means.

According to a preferred arrangement of the invention, the supporting structures of the matrix, on the one hand, and of the push member and the press, on the other hand, consist of carriages mounted on slides, and these carriages are each powered by means, for example, of an electric linear motor type.

Also according to the invention, the matrix comprises four plates for pushing the flanks of the tray cutout, which plates comprise an inlet in the form of an arc of circle in order to form a sort of funnel, and these plates are capable of moving in a converging fashion, when actuated by actuators, between a position of assembling the cutout and a position of pressing the flanks of the tray cutout.

According to another arrangement of the invention, the matrix structure comprises means for taking over the tray cutout when it arrives at the level of the assembly station, which means consist of a plate equipped with suction cups, which plate is capable of moving under the effect of an actuator controlled by an open-center-type valve, which actuator manages said cutout with said suction cups, then it is free, accompanying the movement of the tray and the matrix.

Also according to the invention, the storage site for the tray cutouts is arranged below the level of the sheath transfer conveyor system, parallel thereto, and the transfer of each tray cutout is carried out by means of:

an extractor arm that is pivotably connected to a vertical shaft located on the edge of said conveyor system, and it is moved by suitable actuator-type means in order to move one-quarter of a circle, around a vertical shaft, between the outlet of said storage site and the positioning plane of said tray cutout which is also located on the side of said transfer conveyor, parallel thereto, and an ascent system that includes a vertical guide passage and a lifting device for moving each cutout between the lower level corresponding to the level of said storage site for said tray cutouts and the level of the assembly station that corresponds to that of said conveyor system.

According to another arrangement of the invention, the lifting device consists of an endless belt-type conveyor, which belt comprises a cradle for handling the cutout from below and drives it to a level that is substantially higher than that of said conveyor in order to avoid any interference between the latter and the matrix that carries said cutout for the assembly operation.

Also according to the invention, the vertical passage for guiding cutouts consists of lateral guides that are arranged on each side of the lifting device in order to channel the tray cutout as it rises between the level of its storage site and the level of the assembly station, which vertical passage comprises two distinct parts:

a lower part of which the height corresponds substantially to the dimension of the largest tray cutout format, and which consists of a pair of guides with a U-shaped cross-section arranged opposite one another and of which the posterior, or downstream, wing is stationary so as to act as a soleplate, while the anterior, or upstream, wing forms a flap that can be retracted, by pivoting or lateral movement, in order to enable the passage of said cutout brought by the extractor arm and the deposition thereof on said soleplate, which flap returns to its active guide position before said cutout is released from said extractor arm and before it is taken over by the lifting device and in particular by the active surface of the cradle that pushes said cutout, an upper portion of which the height corresponds to that of the largest tray cutout format, and which consists of a pair of guides with a V-shaped cross-section, also arranged opposite one another, so as to guide said cutout on its lateral edges, in order to avoid any risk of contact with the bond lines on the tongues during the cutout lifting phase.

Also according to the invention, the upper guides of the vertical guide passage can be retracted by actuator-type means, which actuators move said guides laterally in order to enable the matrix to pass during assembly of the tray cutout and the assembly of the latter on the sheath.

According to another arrangement of the invention, the glue guns responsible for applying glue to the tongues of the tray cutout are arranged at the upper end of the soleplate of the lower guides of the guide passage for the tray cutouts, upstream of the upper guides.

Also according to the invention, the storage site for the tray cutouts includes a soleplate that consists of two chain- or endless belt-type conveyors, which conveyors can be independently adjusted transversally and vertically so as to receive tray cutouts of various formats and shapes.

According to another arrangement of the invention, the tray cutout storage site is borne and pivotably connected by means of a vertical shaft arranged laterally on its external side, so as to enable it to be retracted and to allow the operator responsible for maintenance or the like to access the sheath transfer conveyor, which comprises, for example, in front of the assembly station, a station for assembling the ½ American box cutout that forms the sheath of the composite box.

Also according to the invention, the end of the conveyor system comprises a pivoting rack that enables the box lying on said conveyor system to be transferred and pivoted so as to place it in a standing position on the removal conveyor, which removal conveyor is arranged along and below the level of said conveyor system.

BRIEF DESCRIPTION OF THE DRAWINGS

The invention will be further detailed in the following description with the appended drawings, provided for indicative purposes, in which:

FIG. 6 is a diagrammatic and simplified side view of said machine, showing the arrangement of the main constituent parts;

FIG. 7 is a diagrammatic top view of said machine;

FIG. 8 is a cross-section of one of the guides of the vertical passage for guiding the tray cutouts and in particular the lower guide;

FIG. 9 is a cross-section view of one of the upper guides of the vertical guide passage;

DETAILED DESCRIPTION OF THE INVENTION

The process and machine described below enable the box shown in FIG. 1 to be constructed.

This box 1 includes two parts:—a baseless part in the form of a sheath 2 and—a part in the form of a tray 3.

The sheath 2 consists, for example, of a ½ American box with or without upper flaps; the tray 3 acts both as a support and a base for the box 1.

Figure 2:
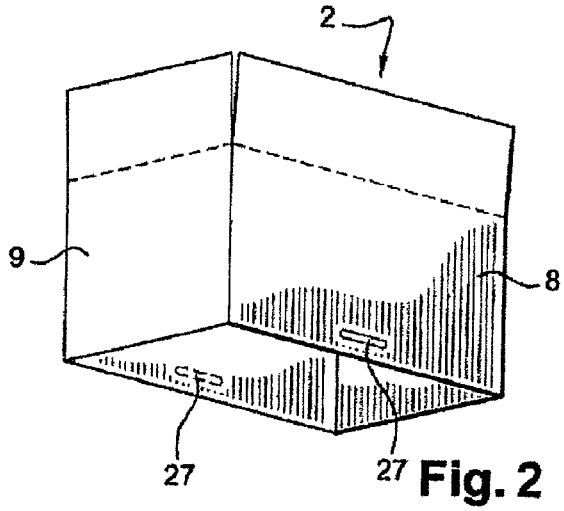
FIG. 2 shows the ½ American box before its assembly with the tray.
Figure 4:
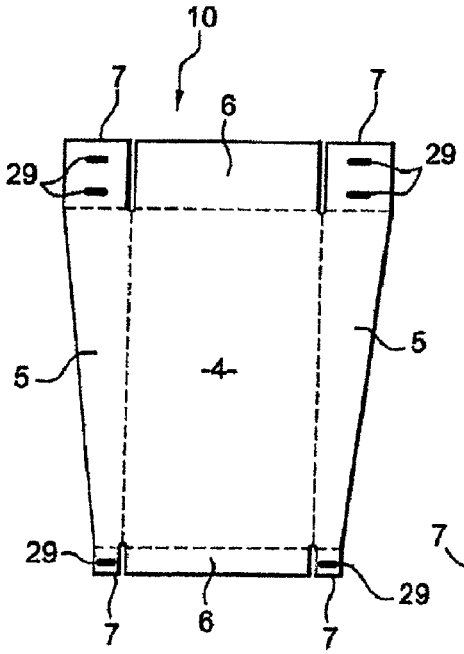
FIG. 4 shows the tray cutout in the form of a simple cardboard blank.
Figure 3:
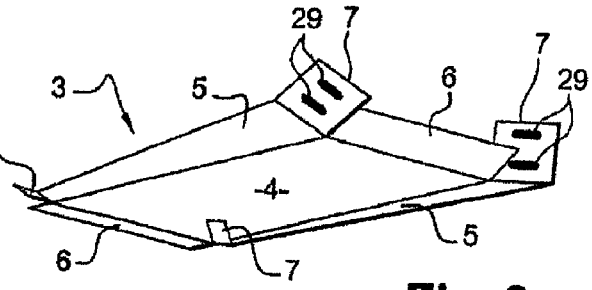
FIG. 3 shows the tray cutout at the beginning of the forming operation, before it has been assembled with the sheath.

The sheath 2, shown in FIG. 2, and the tray 3, shown in FIGS. 3 and 4, are complementary and are assembled together by bonding.

The tray 3 consists of a base 4, flanks 5 and 6, and tongues 7 for bonding, which are located in the extension and at the ends of said longitudinal flanks 5. These tongues 7 are bonded to the flanks 6, outside of the latter.

The tray 3 after erecting thereof, is applied to the lower part of the sheath 2 and is attached by bonding to the longitudinal sides 8; the flanks 5 and 6 form a belt around said sheath; they envelope said longitudinal sides 8 and the transverse sides 9 of said sheath 2.

This design of the mode of assembly of the sheath 2 with the tray 3 enables an easy disassembly of the box 1 to be envisaged, so as to preserve, in particular in the department, only the tray 3, which then serves as a display.

The cardboard blank that constitutes the cutout 10 of the tray 3 is shown in FIG. 4 with a substantially trapezoidal shape. The shape of this cutout 10 and in particular that of the flanks 5 and 6 can vary for reasons of resistance and for aesthetic purposes. These shapes, like the trapezoidal shape of the flanks 5, are taken into account by the shaping machine, as described below.

Figure 5:
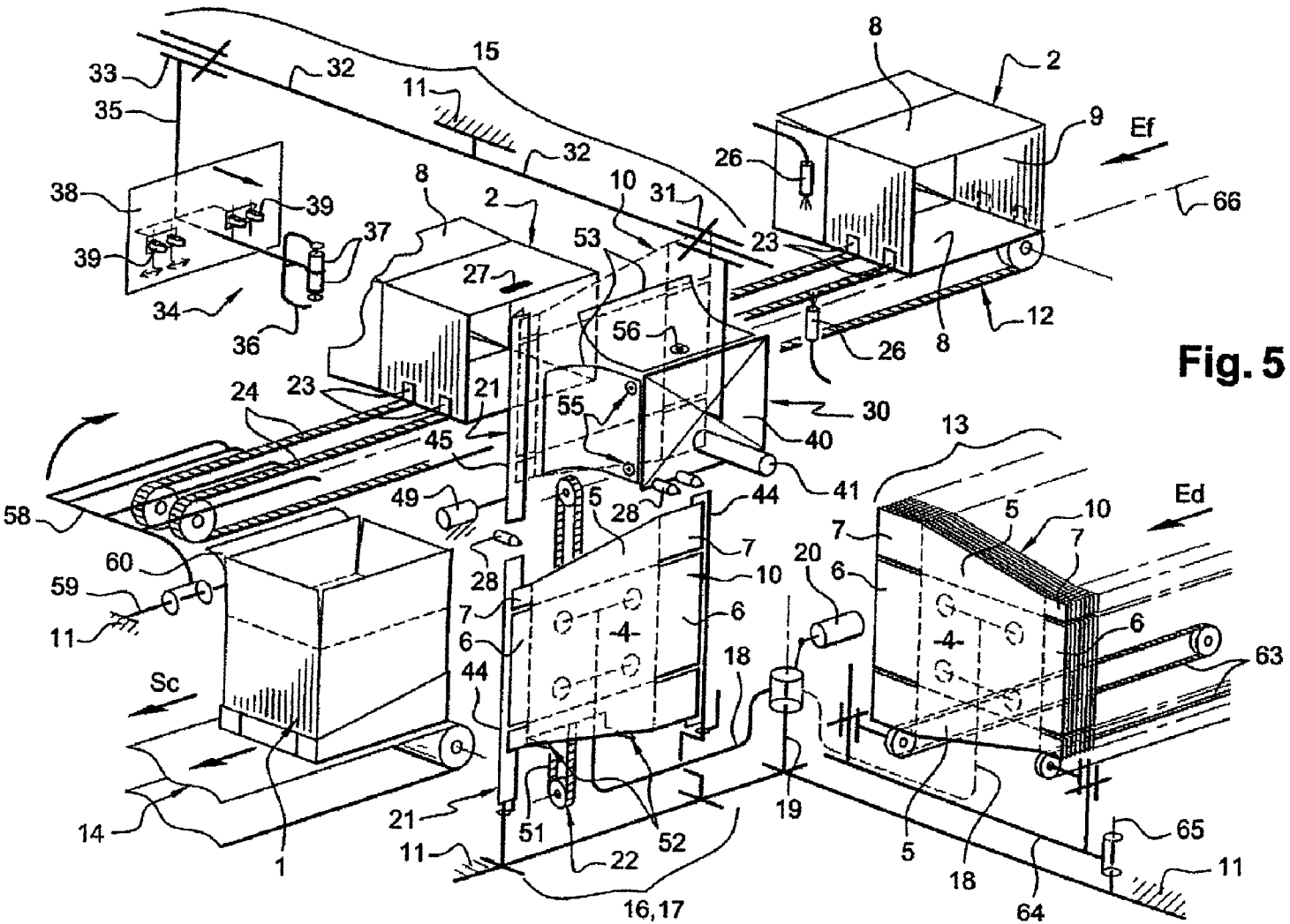
FIG. 5 shows, in the form of a functional diagram and in perspective, the essential elements of the machine for shaping and assembling the composite box.
Figure 10:
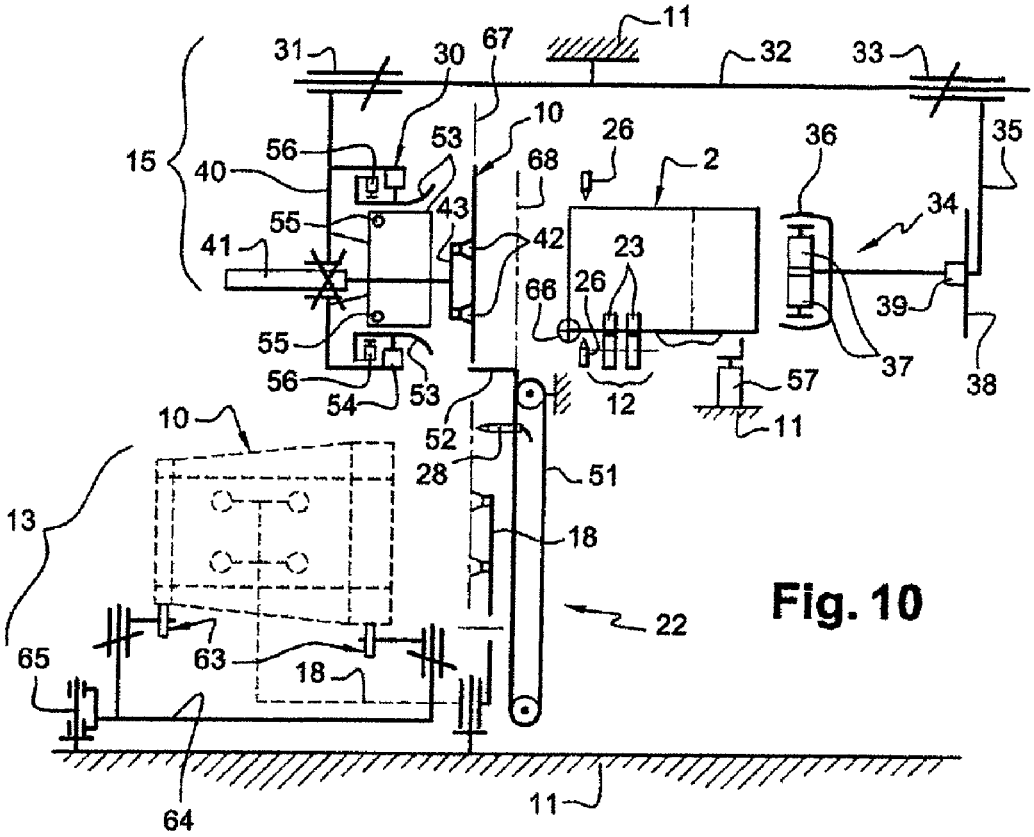
FIG. 10 is a sectional elevation view of the machine seen from upstream.
Figure 11:
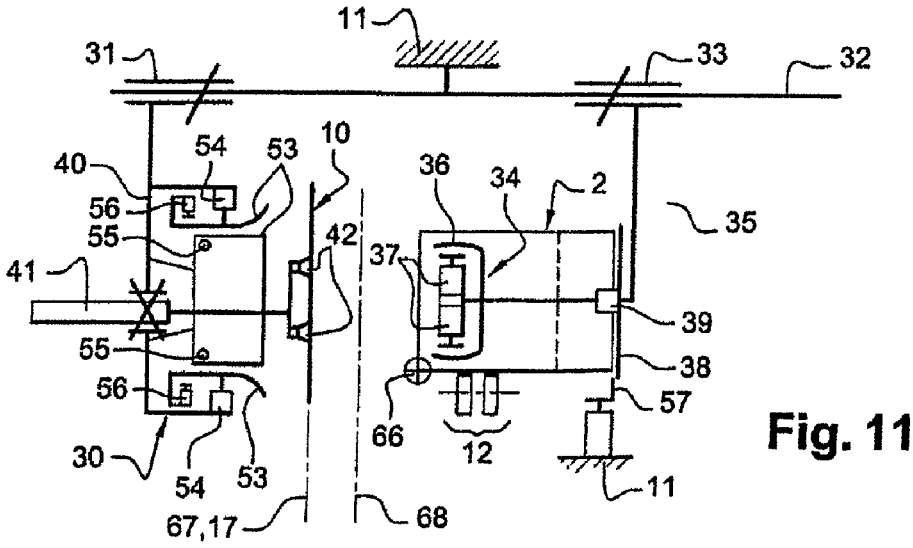
FIGS. 11 to 14 show some phases of the process for shaping the tray cutout and assembling it with the sheath in order to form the box.
Figure 12:
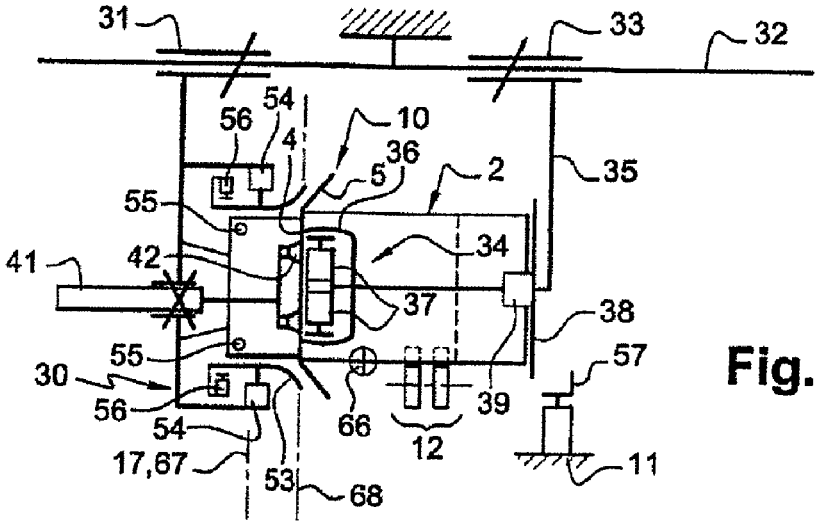

This machine for shaping the box 1 is shown diagrammatically in perspective (FIG. 5) and in the three classic views:—side view (FIG. 6),—top view (FIG. 7) and elevation view (FIG. 10).

The machine is shown (FIG. 5) with its main constituent parts, which parts are secured, directly or indirectly to a general chassis 11.

This machine comprises two inlets: an inlet represented by the arrow Ef for the sheaths 2 that arrive, with their axis of symmetry oriented transversally, on a conveyor system 12, in a suitable repository, and an inlet represented by the arrow Ed for the cutouts 10 for the trays 3, which cutouts are arranged in a storage site 13.

It comprises an outlet represented by an arrow Sc for removing boxes 1 after they have been shaped, i.e. after assembly of the sheath 2 with the tray 3, said removal is performed by means of a conveyor 14.

The construction of the box 1 is performed at the level of an assembly station 15 that is located in the central part of the machine, which station 15 extends above the conveyor system 12, transversally.

This assembly station 15 is supplied with sheaths 2 by the conveyor system 12, directly, and the cutouts 10 for the trays 3 arrive by an ascent system 16, which is arranged along said conveyor system 12, in a plane parallel to the latter; this ascent system 16 is located on the side of the conveyor system 12 that corresponds to the side of the lower end of said sheath 2, i.e. the end intended to be closed off by the tray 3.

The ascent system 16 enables the junction to be created between the level of the storage site 13 for cutouts 10 and that of the conveyor system 12. The storage site 13 is located on the upstream side of the conveyor system 12 and near the ground. The difference in level between the two is greater than the dimension of the largest cutout 10 format; in fact, it corresponds essentially to the dimension of the largest cutout 10 format increased by the dimension of the upper flank.

The cutout 10 storage site 13 is arranged parallel to the conveyor system 12, and these cutouts 10 are perpendicular to said conveyor system 12 when they are in said storage site 13. To orient them parallel to the conveyor system 12 and place them in a vertical guide passage 17, these cutouts 10 are collected in the storage site 13 by means of a pick-up device that is moved in a circular movement with an amplitude corresponding to one-quarter of a circle.

This device for picking up cutouts 10 consists of an extractor arm 18 that is equipped with suction cups, which arm is pivotably connected to a vertical shaft 19;

this shaft 19 is located at the intersection of the plane of the vertical passage 17 and the plane of the outlet of the storage site 13. The extractor arm 18 is moved by suitable actuator-type means 20 or the like, such as, for example, a motor reducer with a connecting rod-crankshaft device.

The cutout 10 is placed, by the extractor arm 18, in vertical guides 21 of the passage 17 so as to be taken over by a lifting device 22 that brings it to the level of the assembly station 15.

When it arrives at the level of the assembly station 15, the cutout 10 is placed opposite the sheath 2, which sheath 2 is waiting on the conveyor system 12, wedged in its repository which is formed by cleats 23 arranged upstream and downstream of said sheath 2, which cleats 23 are secured to belts 24, or chains, of said conveyor system 12.

During their transfer, the sheath 2 and the cutout 10 respectively pass through glue application stations, in front of nozzles that deposit bond lines as they are moving. Nozzles 26 are located upstream of the assembly station 15 and are arranged on the side of the conveyor system 12, which nozzles 26 deposit a bond line 27 at the center, for example, near the edge, on the two longitudinal sides 8 of the sheath 2.

In the same way, nozzles 28 are arranged upstream of the assembly station 15, on the path of the cutouts 10, at the level of the guides 21 of the vertical passage 17; these nozzles 28 deposit bond lines 29 on the tongues 7, which can be seen in FIG. 4, in particular.

At the level of the assembly station 15, the cutout 10 is placed between the sheath 2 and a matrix 30 described below, which is intended in particular to assemble the cutout 3 in the form of a tray 3 by folding flaps 5 and 6 and tongues 7, which folding and assembly are carried out directly at the end of the sheath 2.

The matrix 30 is secured to a supporting structure in the form of a carriage 31; this carriage 31 is transversally mobile with respect to the direction of forward movement of the sheaths 2, and it is guided on a portal frame that is secured to the chassis 11 of the machine. This portal frame includes a horizontal beam 32 acting as a slide, and the carriage 31 can be moved under the effect of a drive member, not shown, of the actuator type, a servomotor with a belt, or an electric linear motor.

On this beam 32 is a second structure in the form of a carriage 33, which carriage 33 is powered in the same way as carriage 31.

This carriage 33 is equipped with a press 34 that is arranged as a cantilever at the end of an arm 35 in the form of a square. This press 34 comprises guides in the form of shoes 36 for penetrating the sheath 2, to its end, which press 34 is also arranged to support the longitudinal walls 8 of said sheath 2 and exert a counter-pressure when the flanks 5 of the tray 3 are shaped on said walls 8.

To create this counter-pressure, the press 34 comprises two actuators 37 that are arranged head-to-tail so as to be located opposite the bond lines 27 and said two actuators 37 are implemented at the right moment, as described below.

The carriage 33 comprises, in addition to the press 34, means intended to transversally move the sheath 2 in order to bring it close to the cutout 10. During this movement, the sheath 2 remains guided in its repository, which consists of cleats 23.

These means, which move the sheath 2, consist of a push member 38 in the form of a shield and a clamp system 39 that grips the edges of said sheath 2. These clamps 39 are maneuvered by means of actuators, which are not shown.

The process of shaping the box 1 will be described in detail below, in the description, in relation to FIGS. 10 to 14.

The matrix 30 includes a general frame 40, and it is connected to the carriage 31 by means of a vertical arm, which arm supports it as a cantilever.

This matrix 30 comprises means for taking over the cutout 10 when it reaches the assembly station 15. These means consist, as shown in FIG. 10 in particular, of an actuator 41 that is attached to the frame 40 and of which the end of the rod is equipped with at least one suction cup 42, which enables the panel 4 of the cutout 10, forming the base, to be grasped by suction. Preferably, the end of the rod of the actuator 41 comprises a plate 43 that is equipped with four suction cups 42 that are distributed over a large part of the surface of the base 4 of the cutout 10.

The actuator 41 has the special feature of being supplied by means of an open-center valve, not shown. This special feature enables the actuator 41 to be released after the cutout 10 has been grasped; it is then subjected to the movements of the cutout 10 that are imposed by the matrix 30.

When it moves transversally, the matrix 30 passes through the upstream and downstream guide 21 plane of the passage 17, and the width of this matrix 30 can, depending on the shapes and dimensions of the cutouts 10, be greater than the space between said upstream and downstream guides 21.

These guides 21 are therefore designed to be capable:—at the level of the station 15, of being retracted on each side of the cutout 10 and, in addition,—at the level of the storage site 13, to be opened in order to receive the cutout 10 that is brought by the extractor arm 18.

These lateral guides 21 of the vertical passage 17 are divided over the height into two parts, between which the glue application nozzles 28 mentioned above are provided. These guides 21 include:—guides 44 that take over the cutout 10 at the level of the storage site 13 and—guides 45 that take over the same cutout 10 at the level of the assembly station 15.

FIG. 8 diagrammatically shows, from a top and horizontal cross-section view, a guide 44. In the active guide position, the cross-section of this guide 44 has a U-shape. This particular U comprises—a posterior, or downstream wing, which is stationary in order to act as a soleplate 46 and on which the cutout 10 is pressed when it is brought by the extractor arm 18, and—a mobile anterior, or upstream wing, which acts as a flap 47; this flap 47 is mobile, and maneuvered, for example, by means of an actuator 48.

FIG. 9 similarly shows a cross-section of the upper guide 45 of which the cross-section is more V-shaped or square, which guide 45 is maneuvered by means of an actuator 49, or a pair of actuators, in order to be laterally retracted and open the passage so as to allow the matrix 30 to pass when the tray 3 is shaped and assembled on the sheath 2.

The guide 45 has a V-shaped cross-section so as to avoid wiping the bond lines 29 located on the tongues 7 of the cutout 10, and which have been deposited by the nozzles 28 that are located just upstream of said guides 45. In fact, the cutout 10 is guided by the edge of its flanks 6 and the tongues 7.

As indicated above, the glue is deposited in the form of one or more lines 29 on the tongues 7, during the transfer of the cutout 10 between the level of the storage site 13 and that of the assembly station 15 by the ascent system 16.

This ascent system 16 includes, in addition to the passage 17 and guides 21 detailed above, the lifting device 22, which acts as a conveyor. It is equipped with an endless belt 51 that comprises at least one cradle 52, which cradles is arranged so as to take over the cutout 10 when it has been released by the extractor arm 18. This cradle 52 has a U-shape of which the position of the projecting branches is adapted to the shape of the flanks 5 of the cutouts 10 so as to transport said cutouts properly in the guides 21.

The upper part of the lifting device 22 is located clearly below the assembly station 15 so as not to interfere with the matrix 30 when it moves transversally. The cradle 52 is secured to the belt 51 so as to be capable of carrying said cutout 10 clearly above the upper level of the lifting device 22.

The matrix 30 comprises four pressing plates 53, each in correspondence with the sides 8 and 9 of the sheath 2.

These plates 53 (FIG. 10) are secured to the frame 40 by means of actuators 54, in particular; they are guided with respect to said frame 40 by suitable means and they are each mobile perpendicularly to the respective sides of the sheath 2 under the effect of said actuators 54.

These plates 53 are rounded at the level of their inlet, forming a funnel, in order to perform, in a first stage, a progressive bending of the flaps 5 and 6 of the cutout 10.

In a second stage, they are activated by the actuators 54 in order to perform the pressing and bonding of the tongues 7 on the flaps 6 and the pressing of the flaps 5 on the sides 8 of the sheath 2.

To improve the bonding, the plates 53 comprise complementary actuators that act, specifically, as a press at the level of the various bonding points.

Thus, the lateral plates 53 comprise actuators 55, which can be seen in FIG. 7, which press the tongues 7 on the flanks 6 of the cutout 10 in order to secure the bonding at the level of the bond lines 29.

The plates 53 located above and below the sheath 2 also comprise actuators 56, which can be seen in FIGS. 10 and following, which are arranged opposite actuators 37 of the press 34, mentioned earlier.

Actuators 56 act at the same time as actuators 37, when the tray 3 is in place, formed on the end of the sheath 2.

Figure 1:
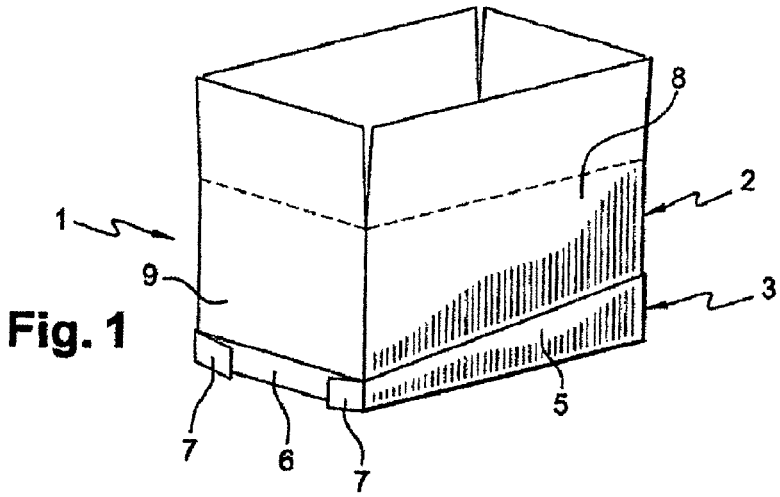
FIG. 1 shows a composite box obtained by the process and the machine according to the invention.

The positioning of these actuators 55 and 56 is shown symbolically on the plates 53 in FIG. 1 so as not to complicate said figure.

When the operation of assembly and formation of the box 1 is completed, the actuators 55 and 56 are deactivated and the plates 53 return to the inactive position under the effect of their actuators 54.

In a simultaneous movement, the carriage 31 that bears the matrix 30 and the carriage 33 that bears the press 34 withdraw from the assembly station. In its movement, the carriage 33, which comprises the clamp system 39, extracts the box 1 from the matrix 30, and retracts to a position established by a retractable stop 57.

This stop 57 is installed on the general chassis 11 of the machine, under the level of the conveyor 12, and, simultaneously to the deactivation of the clamps 39, it holds the box 1 in order to enable the press 34 to completely leave the sheath 2 and return to the inactive position.

It is noted that, in the inactive position, the stop 57 is slightly ahead of the edge of the sheath 2 (FIG. 10). This slightly advanced position enables it to position the box 1 on the conveyor 12, between its cleats 23, before the flanks 5, 6 and the tongues 7 reach the repository of the sheath 2, i.e. the chains 24 and said cleats 23 of the conveyor system 12.

When the box 1 is free, the conveyor system 12 moves it to the outlet Sc where it is pivoted onto the removal conveyor 14.

The pivoting of the box 1 is performed by means of a rack 58 of which the bars extend on each side of and between the belts 24 or chains of the conveyor 12. This rack 58 pivots around a longitudinal shaft 59 arranged on the side of the conveyor 12, under the effect of an actuator, for example, which is not shown.

The rack 58 extends toward the conveyor 14 in the form of a plate 60 that is profiled so as to accompany the box 1 in its descent on the conveyor 14.

The storage site 13 for storing the cutouts is arranged so as to be capable of accepting cutouts 10 with a wide variety of formats and shapes. It consists of two conveying arms 63 that act as a soleplate, which arms 63 are separately adjustable, in particular in height. They can thus accept and carry, without any difficulty, cutouts 10 with complicated shapes, such as, for example, cutouts with flanks 5 with a trapezoidal shape or the like.

In addition, to facilitate access to the machine, in general, and in particular access to the upstream portion, the storage site 13 comprises a frame 64 that is laterally pivotably connected to the frame 11 of the machine. The storage site 13 can be retracted, as shown in FIG. 7, around a vertical shaft 65 that is located on its external side.

FIGS. 10 to 14 show steps of the process for shaping the box 1.

In FIG. 10, the sheath 2 is wedged longitudinally in its repository, which consists of cleats 23 and is positioned transversally on the reference line 66 that is located on the side of the conveyor system 12.

Also in this FIG. 10, the cutout 10 is taken over by the suction cups 42 of the plate 43 and it waits in the plane 67 of the vertical passage 17.

In a first stage (FIG. 11), the press 34 penetrates the sheath 2 to its end, and, when the push member 38 reaches the edge of said sheath, the clamps 39 close on these edges and said sheath 2 is driven toward the matrix 30 until it is in an area shown in the figure by a line 68 that corresponds to the plane in which the sheath 2 and the cutout 10 are brought together, which cutout is supported by said sheath 2.

The cradle 52 of the ascent system 16 withdraws, and (FIG. 12) the sheath 2 and the matrix 30 converge toward the assembly plane 68, and when they reach said plane 68, the matrix 30 has already begun to fold down the tongues 7 and flanks 5 and 6.

Figure 13:
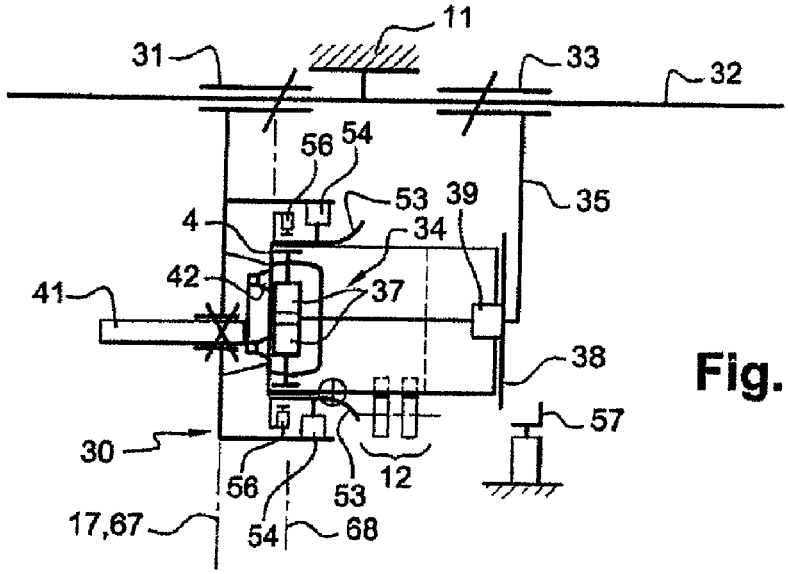
Figure 14:
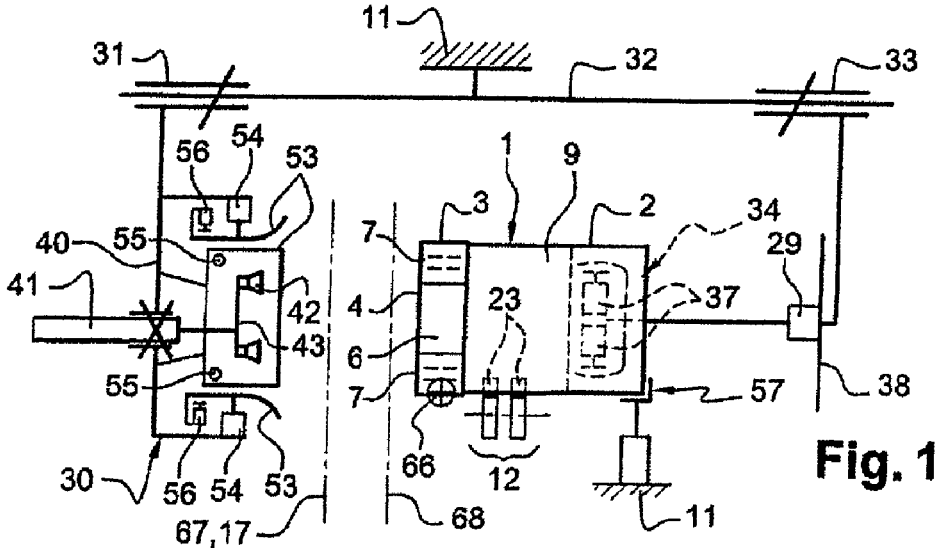

Once the cutout 10 is supported on the end edge of the sheath 2, the matrix 30 continues its course and completes the folding of the tongues 7 and the flanks 5 and 6; the tray 3 thus formed covers, with its entire depth, said end of the sheath 2 (FIG. 13).

At this stage, the actuators 54 of the matrix 30 act in order to generally apply the plates 53 on the flanks 5 and 6 and on the tongues 7, as the various actuators 55 and 56 are specifically applied at the bonding points, which actuators 56 act opposite the actuators 37 of the press 34.

At the same time, the suction cups 42 of the plate 43 release the base 4 of the tray 3.

The matrix 30 can then withdraw after the deactivation of the various actuators 55, 56 and 37, which act as presses, and after the various plates 53 have been arranged in their inactive positions by their respective actuators 54.

The sheath 2 also withdraws, between its cleats 23, driven by the clamps 39 o the carriage 33, until the stop 57, which has been put in the active position. At this level, the clamps 39 are deactivated and the carriage 33 that bears the press 34 continues the withdrawal movement in order to move said press 34 away from the sheath 2 until it reaches its inactive position.

Conveyor 12 can then bring the box 1, and the latter is ejected onto conveyor 14 as mentioned earlier.

The invention claimed is:

1. Machine for constructing a composite box, the machine comprising:

a conveyor system for transferring a sheath, which has been pre-assembled at a forming station, which sheath is transferred with its repository;

a storage site for storing tray cutouts;

means forming extractor arms for picking up said tray cutouts one by one in said storage site and bringing them to a repository, at the level of an assembly station, opposite said sheath;

means for applying glue to the edges of the longitudinal sides of the sheath and the flanks of the tray cutout as they are moving toward said assembly station;

a portal frame that is arranged transversally above said conveyor system, in the median vertical plane of said assembly station, which portal frame, in the form of a beam, comprises two mobile structures:

a first structure that has a matrix for shaping the tray cutout, and a second structure comprising a push member suitable for cooperating with the free periphery of said sheath in order to drive it toward said matrix and cause said sheath to act as a support;

means arranged on the matrix in order to press said flanks of the tray cutout on said sheath and press-type means, which press is arranged on the supporting structure of said push member, upstream of the latter, and penetrates to the end of said sheath in order to maintain, with suitable actuator-type means, a counter-pressure opposite the pressing means in the form of actuators arranged on the matrix.

2. Machine according to claim 1, wherein the supporting structures of the matrix, on the one hand, and of the push member and the press, on the other hand, consist of carriages, respectively, which carriages are mounted on slides, and are each moved by a drive member.

3. Machine according to claim 1, characterized in that the matrix comprises four plates for pushing the flanks and the tongues of the tray cutout, which plates comprise an inlet in the form of an arc of circle in order to form a sort of funnel, and these plates move in a converging fashion, when actuated by actuators, between a position of assembling the cutout and a position of pressing said flanks of the tray cutout.

4. Machine according to claim 3, wherein the frame of the matrix comprises means for taking over the tray cutout when it arrives at the level of the assembly station, which means consist of a plate equipped with suction cups, which plate moves under the effect of an actuator controlled by an open-center-type valve, which actuator manages said cutout with said suction cups, then it is free, accompanying the movement of said cutout and the matrix.

5. Machine according to claim 1, wherein the storage site for the tray cutouts is arranged below the level of the sheath transfer conveyor system, parallel thereto, and wherein the transfer of each tray cutout is carried out by means of:

an extractor arm that is pivotably connected to a vertical shaft located on the edge of said conveyor system, and said extractor arm is moved by suitable actuator-type means in order to move one-quarter of a circle between the outlet of said storage site and the positioning plane of said tray cutout which is also located on the side of said transfer conveyor, parallel thereto, and an ascent system that includes a vertical guide passage and a lifting device for moving each cutout between the lower level corresponding to the level of said storage site for said tray cutouts and the level of the assembly station that corresponds to that of said conveyor system.

6. Machine according to claim 5, wherein the lifting device consists of an endless belt-type conveyor, which belt comprises a cradle for handling the cutout from below, on the edge of the lower flank, and drives it to a level that is substantially higher than that of said lifting device in order to avoid any interference between the latter and the matrix.

7. Machine according to claim 5, wherein the vertical passage for guiding the cutouts consists of lateral guides that are arranged on each side of the lifting device in order to channel the tray cutout as it rises between the level of its storage site and the level of the assembly station, which vertical passage comprises two distinct parts:

a lower part of which the height corresponds substantially to the dimension of the largest tray cutout format, and which consists of a pair of guides with a U-shaped cross-section arranged opposite one another and of which the posterior, or downstream, wing is stationary so as to act as a soleplate, while the anterior, or upstream, wing forms a flap that can be retracted, by pivoting or lateral movement, in order to enable the passage of said cutout brought by the extractor arm and the deposition thereof on said soleplate, which flap returns to its active guide position before said cutout is released from said extractor arm and before it is taken over by the lifting device and in particular by the active surface of said cradle that pushes said cutout toward the assembly station, an upper portion of which the height corresponds to that of the largest tray cutout format, and which consists of a pair of guides with a V-shaped cross-section, also arranged opposite one another, so as to guide said cutout with its lateral edges.

8. Machine according to claim 7, wherein the upper guides of the vertical guide passage are configured to be retracted by actuators, which actuators move said guides laterally in order to space them apart and enable the matrix to pass.

9. Machine according to claim 8, wherein the nozzles responsible for applying glue to the tongues of the tray cutout are arranged at the upper end of the lower guides of the guide passage for said tray cutouts, upstream of the upper guides.

10. Machine according to claim 1, wherein the storage site for the tray cutouts includes a soleplate that consists of two chain- or endless belt-type conveyors, which conveyors can be independently adjusted transversally and vertically so as to receive tray cutouts of various formats and shapes.

11. Machine according to claim 10, wherein the storage site is borne and pivotably connected by means of a vertical shaft arranged laterally on the external side of said storage site, so as to enable it to be retracted and to allow the operator responsible for maintenance or the like to access the sheath transfer conveyor, which conveyor system comprises, for example, in front of the assembly station, a station for assembling the ½ American box cutout that forms the sheath of the composite box.

12. Machine according to claim 1, wherein the end of the conveyor system comprises a pivoting rack that enables the box lying on said conveyor system to be transferred and pivoted so as to place on the removal conveyor, which conveyor is arranged parallel to and below the level of said conveyor system.

* * * * *